US006992548B2

(12) United States Patent
Fukunaga

(10) Patent No.: US 6,992,548 B2
(45) Date of Patent: Jan. 31, 2006

(54) RF MODULE AND METHOD FOR ARRANGING THROUGH HOLES IN RF MODULE

(75) Inventor: Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/733,349

(22) Filed: Dec. 12, 2003

(65) Prior Publication Data

US 2004/0145434 A1 Jul. 29, 2004

(30) Foreign Application Priority Data

Dec. 16, 2002 (JP) ..... 2002-364054

(51) Int. Cl.
*H01P 1/207* (2006.01)
*H01P 7/06* (2006.01)

(52) U.S. Cl. ..... 333/208; 333/227

(58) Field of Classification Search ..... 333/208, 333/219, 219.1, 239, 248, 227
See application file for complete search history.

(56) References Cited

U.S. PATENT DOCUMENTS 4,727,342 A * 2/1988 Ishikawa et al. ..... 333/219.1
5,208,561 A * 5/1993 Delestre et al. ..... 333/246
5,982,256 A * 11/1999 Uchimura et al. ..... 333/239
6,133,805 A * 10/2000 Jain et al. ..... 333/238
6,356,172 B1 3/2002 Koivisto et al.
6,380,825 B1 * 4/2002 Takenoshita et al. ..... 333/239
6,788,918 B2 * 9/2004 Saitoh et al. ..... 333/239

FOREIGN PATENT DOCUMENTS

| | | |
|---|---|---|
| JP | 06-053711 | 2/1994 |
| JP | A 10-107518 | 4/1998 |
| JP | A 10-135714 | 5/1998 |
| JP | A 11-68416 | 3/1999 |
| JP | 11-284409 | 10/1999 |
| JP | A 11-284409 | 10/1999 |

OTHER PUBLICATIONS

Uchimura et al., Hiroshi, Development of a "Laminated Waveguide", IEEE Transactions on Microwave Theory and Techniques, vol. 46, No. 12, Dec. 1998, pp. 2438-2443.
Ito et al., Masaharu, A 60 GHz-Band Planar Dielectric Waveguide Filter for Flip-Chip Modules, IEEE MTT-S Digest 2001, pp. 1597-1600.

* cited by examiner

*Primary Examiner*—Seungsook Ham
(74) *Attorney, Agent, or Firm*—Oliff & Berridge, PLC

(57) ABSTRACT

The present invention is directed to optimize arrangement of through holes and enable electromagnetic waves to be efficiently propagated. A cylindrical waveguide has a dielectric substrate, ground electrodes which face each other, and a plurality of through holes for bringing the ground electrodes into conduction. In the case of determining arrangement of the through holes, first, the relation between a center interval and the radius of each of the through holes is obtained from required attenuance of electromagnetic waves. On the basis of the obtained relation, arrangement of the through holes is determined. Irrespective of a signal wavelength and the like conventionally used as parameters, the arrangement of the through holes can be optimized.

7 Claims, 16 Drawing Sheets

FIG. 12A case 1
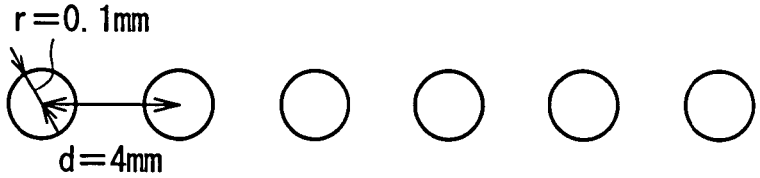
FIG. 12B case 2
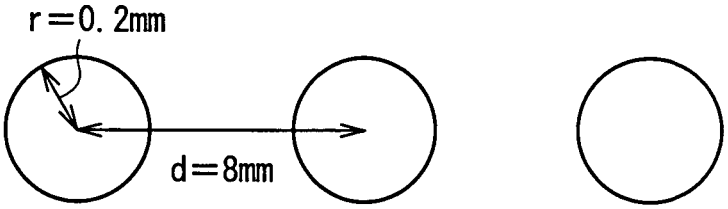
FIG. 12C case 3
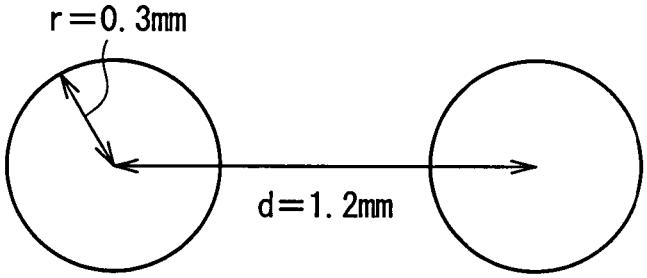

θ =30°

θ =24°

θ =20°

θ =18°

θ =15°

θ =12°

θ =10°

FIG. 15A

THROUGH HOLE RADIUS r=0.1mm RESONATOR THICKNESS h=0.2mm

| θ (degree) | f (GHz) | Q | fr (GHz) | Qr | d (mm) | A (dB) |
|---|---|---|---|---|---|---|
| 30 | 22.99 | 275.10 | 22.87 | 20.66 | 0.90 | -6.95 |
| 24 | 23.55 | 283.02 | 23.51 | 63.97 | 0.73 | -9.22 |
| 20 | 23.89 | 289.16 | 23.88 | 146.49 | 0.62 | -11.75 |
| 18 | 24.05 | 291.62 | 24.04 | 200.22 | 0.56 | -13.60 |
| 15 | 24.27 | 294.96 | 24.27 | 273.15 | 0.47 | -17.83 |
| 12 | 24.47 | 298.87 | 24.47 | 296.69 | 0.37 | -25.93 |
| 10 | 24.59 | 300.99 | 24.59 | 300.97 | 0.31 | -37.48 |
| CYLINDER (THEORETICAL VALUE) | 24.98 | 307.80 | 24.98 | 307.80 | | |

FIG. 15B

THROUGH HOLE RADIUS r=0.1mm RESONATOR THICKNESS h=0.3mm

| θ (degree) | f (GHz) | Q | fr (GHz) | Qr | d (mm) | A (dB) |
|---|---|---|---|---|---|---|
| 30 | 23.00 | 379.75 | 22.89 | 21.06 | 0.90 | -6.95 |
| 24 | 23.56 | 393.95 | 23.53 | 68.68 | 0.73 | -9.22 |
| 20 | 23.90 | 403.31 | 23.89 | 167.71 | 0.62 | -11.75 |
| 18 | 24.06 | 407.36 | 24.05 | 249.22 | 0.56 | -13.60 |
| 15 | 24.28 | 414.80 | 24.28 | 368.46 | 0.47 | -17.83 |
| 12 | 24.48 | 421.00 | 24.48 | 418.58 | 0.37 | -25.93 |
| 10 | 24.60 | 425.28 | 24.60 | 425.54 | 0.31 | -37.48 |
| CYLINDER (THEORETICAL VALUE) | 24.98 | 438.62 | 24.98 | 438.62 | | |

FIG. 15C

THROUGH HOLE RADIUS r=0.1mm RESONATOR THICKNESS h=0.4mm

| θ (degree) | f (GHz) | Q | fr (GHz) | Qr | d (mm) | A (dB) |
|---|---|---|---|---|---|---|
| 30 | 23.01 | 469.69 | 22.89 | 21.38 | 0.90 | -6.95 |
| 24 | 23.56 | 490.35 | 23.53 | 70.88 | 0.73 | -9.22 |
| 20 | 23.91 | 504.42 | 23.90 | 181.17 | 0.62 | -11.75 |
| 18 | 24.07 | 510.85 | 24.06 | 280.23 | 0.56 | -13.60 |
| 15 | 24.29 | 520.06 | 24.29 | 451.90 | 0.47 | -17.83 |
| 12 | 24.49 | 531.07 | 24.49 | 525.72 | 0.37 | -25.93 |
| 10 | 24.61 | 535.10 | 24.61 | 528.15 | 0.31 | -37.48 |
| CYLINDER (THEORETICAL VALUE) | 24.98 | 556.98 | 24.98 | 556.98 | | |

| θ (degree) | r/d |
|---|---|
| 30 | 0.0556 |
| 24 | 0.0683 |
| 20 | 0.0812 |
| 18 | 0.0899 |
| 15 | 0.1073 |
| 12 | 0.1336 |
| 10 | 0.1600 |

FIG. 16

| θ (degree) | | |
|---|---|---|
| r=0.1mm | r=0.2mm | r=0.3mm |
| 30.00 | 58.73 | 88.66 |
| 24.00 | 46.40 | 68.30 |
| 20.00 | 38.42 | 55.92 |
| 18.00 | 34.48 | 49.97 |
| 15.00 | 28.64 | 41.27 |
| 12.00 | 22.85 | 32.79 |
| 10.00 | 19.01 | 27.22 |

FIG. 17

FIG. 18A

THROUGH HOLE RADIUS r=0.2mm RESONATOR THICKNESS h=0.2mm

| θ (degree) | f (GHz) | Q | fr (GHz) | Qr | d (mm) | A (dB) |
|---|---|---|---|---|---|---|
| 58.73296 | 21.19 | 268.55 | 20.14 | 13.27 | 1.62 | -6.76 |
| 46.39951 | 22.24 | 276.90 | 21.91 | 34.90 | 1.38 | -9.09 |
| 38.41832 | 22.91 | 283.48 | 22.81 | 92.58 | 1.18 | -11.72 |
| 34.48327 | 23.22 | 286.83 | 23.17 | 151.70 | 1.08 | -13.64 |
| 28.63711 | 23.65 | 291.86 | 23.65 | 252.02 | 0.91 | -17.99 |
| 22.84636 | 24.04 | 296.54 | 24.04 | 293.00 | 0.74 | -26.29 |
| 19.01041 | 24.27 | 299.26 | 24.27 | 299.15 | 0.62 | -38.10 |
| CYLINDER (THEORETICAL VALUE) | 24.98 | 307.80 | 24.98 | 307.80 | | |

FIG. 18B

THROUGH HOLE RADIUS r=0.2mm RESONATOR THICKNESS h=0.3mm

| θ (degree) | f (GHz) | Q | fr (GHz) | Qr | d (mm) | A (dB) |
|---|---|---|---|---|---|---|
| 58.73296 | 21.20 | 373.42 | 20.15 | 13.44 | 1.62 | -6.76 |
| 46.39951 | 22.25 | 385.89 | 21.92 | 36.17 | 1.38 | -9.09 |
| 38.41832 | 22.92 | 396.71 | 22.82 | 102.00 | 1.18 | -11.72 |
| 34.48327 | 23.23 | 402.40 | 23.19 | 178.75 | 1.08 | -13.64 |
| 28.63711 | 23.67 | 410.76 | 23.66 | 335.74 | 0.91 | -17.99 |
| 22.84636 | 24.05 | 417.45 | 24.05 | 412.84 | 0.74 | -26.29 |
| 19.01041 | 24.29 | 423.34 | 24.28 | 422.97 | 0.62 | -38.10 |
| CYLINDER (THEORETICAL VALUE) | 24.98 | 438.62 | 24.98 | 438.62 | | |

FIG. 18C

THROUGH HOLE RADIUS r=0.2mm RESONATOR THICKNESS h=0.4mm

| θ (degree) | f (GHz) | Q | fr (GHz) | Qr | d (mm) | A (dB) |
|---|---|---|---|---|---|---|
| 58.73296 | 21.21 | 463.75 | 20.15 | 13.53 | 1.62 | -6.76 |
| 46.39951 | 22.26 | 480.94 | 21.93 | 36.84 | 1.38 | -9.09 |
| 38.41832 | 22.92 | 495.16 | 22.82 | 107.45 | 1.18 | -11.72 |
| 34.48327 | 23.24 | 503.41 | 23.19 | 195.99 | 1.08 | -13.64 |
| 28.63711 | 23.67 | 515.04 | 23.66 | 401.13 | 0.91 | -17.99 |
| 22.84636 | 24.06 | 525.97 | 24.06 | 518.37 | 0.74 | -26.29 |
| 19.01041 | 24.29 | 533.65 | 24.29 | 533.29 | 0.62 | -38.10 |
| CYLINDER (THEORETICAL VALUE) | 24.98 | 556.98 | 24.98 | 556.98 | | |

FIG. 19A

THROUGH HOLE RADIUS r=0.3mm RESONATOR THICKNESS h=0.2mm

| θ (degree) | f (GHz) | Q | fr (GHz) | Qr | d (mm) | A (dB) |
|---|---|---|---|---|---|---|
| 88.6634 | 19.55 | 263.96 | 17.35 | 9.15 | 2.00 | -7.82 |
| 68.3 | 20.96 | 271.49 | 20.13 | 22.08 | 1.86 | -9.30 |
| 55.9194 | 21.94 | 278.34 | 21.68 | 64.30 | 1.66 | -11.83 |
| 49.969 | 22.41 | 282.28 | 22.30 | 119.23 | 1.53 | -13.78 |
| 41.2709 | 23.07 | 288.40 | 23.05 | 236.72 | 1.32 | -18.26 |
| 32.7863 | 23.65 | 294.21 | 23.64 | 290.88 | 1.08 | -26.83 |
| 27.221 | 23.98 | 297.63 | 23.98 | 297.54 | 0.91 | -39.03 |
| CYLINDER (THEORETICAL VALUE) | 24.98 | 307.80 | 24.98 | 307.80 | | |

FIG. 19B

THROUGH HOLE RADIUS r=0.3mm RESONATOR THICKNESS h=0.3mm

| θ (degree) | f (GHz) | Q | fr (GHz) | Qr | d (mm) | A (dB) |
|---|---|---|---|---|---|---|
| 88.6634 | 19.57 | 370.59 | 17.36 | 9.24 | 2.00 | -7.82 |
| 68.3 | 20.98 | 379.74 | 20.14 | 22.60 | 1.86 | -9.30 |
| 55.9194 | 21.95 | 389.69 | 21.69 | 68.81 | 1.66 | -11.83 |
| 49.969 | 22.42 | 396.14 | 22.31 | 135.62 | 1.53 | -13.78 |
| 41.2709 | 23.08 | 405.82 | 23.06 | 309.52 | 1.32 | -18.26 |
| 32.7863 | 23.66 | 415.29 | 23.66 | 408.82 | 1.08 | -26.83 |
| 27.221 | 23.99 | 419.58 | 23.99 | 420.83 | 0.91 | -39.03 |
| CYLINDER (THEORETICAL VALUE) | 24.98 | 438.62 | 24.98 | 438.62 | | |

FIG. 19C

THROUGH HOLE RADIUS r=0.3mm RESONATOR THICKNESS h=0.4mm

| θ (degree) | f (GHz) | Q | fr (GHz) | Qr | d (mm) | A (dB) |
|---|---|---|---|---|---|---|
| 88.6634 | 19.57 | 464.32 | 17.36 | 9.29 | 2.00 | -7.82 |
| 68.3 | 20.98 | 474.38 | 20.14 | 22.87 | 1.86 | -9.30 |
| 55.9194 | 21.95 | 488.31 | 21.69 | 71.34 | 1.66 | -11.83 |
| 49.969 | 22.43 | 496.31 | 22.31 | 145.64 | 1.53 | -13.78 |
| 41.2709 | 23.09 | 509.64 | 23.07 | 367.81 | 1.32 | -18.26 |
| 32.7863 | 23.66 | 522.94 | 23.66 | 513.03 | 1.08 | -26.83 |
| 27.221 | 24.00 | 531.38 | 24.06 | 531.37 | 0.91 | -39.03 |
| CYLINDER (THEORETICAL VALUE) | 24.98 | 556.98 | 24.98 | 556.98 | | |

FIG. 21A r=0.1mm
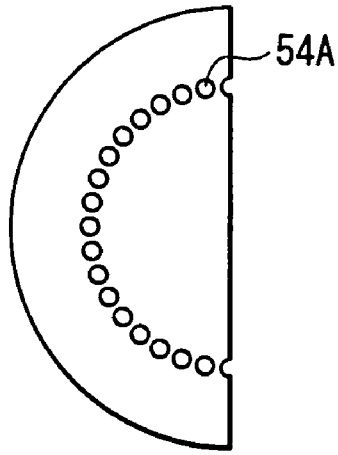
FIG. 21B r=0.2mm
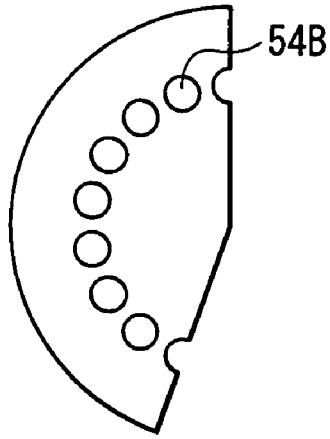
FIG. 21C r=0.3mm
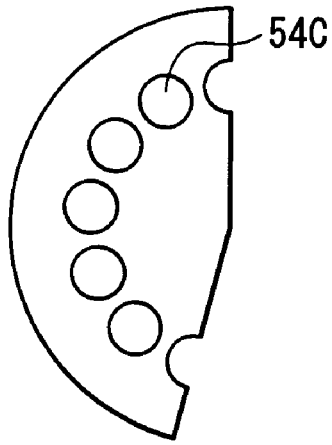

FIG. 22A r=0.1mm
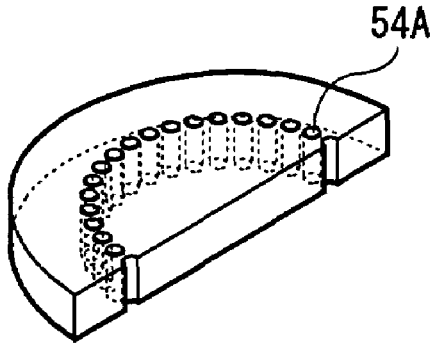
FIG. 22B r=0.2mm
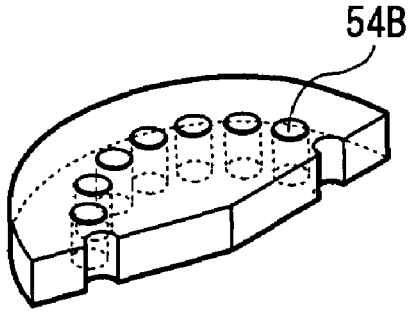
FIG. 22C r=0.3mm
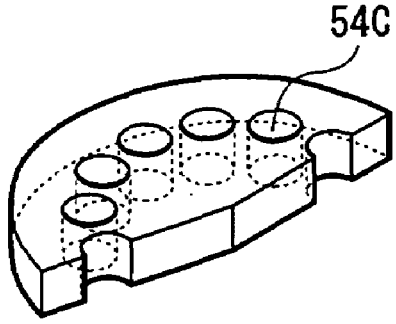

RF MODULE AND METHOD FOR ARRANGING THROUGH HOLES IN RF MODULE

BACKGROUND OF THE INVENTION

1. Field of the Invention

The present invention relates to an RF module used for propagating a signal in a high frequency band of microwaves, millimeter waves, or the like and a method for arranging through holes in an RF module.

2. Description of the Related Art

Conventionally, as transmission lines for transmitting a high frequency signal in a microwave band, a millimeter wave band, and the like, a strip line, a waveguide, a dielectric waveguide, and the like are known. They are also known as components of a resonator and a filter for high frequency. An example of a module formed by using any of the components for high frequency is an MMIC (Monolithic Microwave Integrated Circuit).

Recently, there is a known structure that a dielectric waveguide line is formed by a layer stacking technique in a circuit board of a multilayer structure. The structure has a plurality of ground conductors stacked while sandwiching dielectrics and through holes having metalized inner face and provided to make the ground conductors conductive, and electromagnetic waves propagate in a region surrounded by the ground conductors and the through holes.

In such a waveguide of a layer stacked type, when the intervals of arranging through holes are too large, electromagnetic waves leak from the intervals between neighboring through holes. It is consequently necessary to set the intervals of providing through holes to be smaller than a certain value. Conventionally, the intervals of providing through holes are generally determined in consideration of signal wavelength and dielectric constant of a dielectric substrate. For example, Japanese Unexamined Patent Application No. Hei 6-53711 discloses a technique of a waveguide in which through holes are provided at intervals each of which is smaller than a cut-off wavelength. Japanese Unexamined Patent Application No. Hei 11-284409 discloses a technique of a waveguide in which through holes are provided at intervals each of which is smaller than the half of a guide wavelength in a travel direction of electromagnetic waves.

As described above, in the conventional waveguide of the layer stacked type, the intervals of providing through holes are determined in consideration of, mainly, a signal wavelength. However, particularly, the relation between the intervals of providing through holes and a conductor loss, a radiation loss, and the like has not been accurately clarified from mathematic viewpoint. The arrangement of through holes considering only the signal wavelength is not always in a true optimum state.

SUMMARY OF THE INVENTION

The present invention has been achieved in consideration of such a problem and its object is to provide an RF module in which arrangement of through holes is optimized so that electromagnetic waves can propagate efficiently and a method of arranging through holes in the RF module.

According to the invention, there is provided an RF module having a plurality of through holes, in which an electromagnetic wave propagates by using a region surrounded by the through holes, wherein the plurality of through holes are arranged so as to satisfy the following conditional expression (A) where d denotes an interval between centers of neighboring through holes and r indicates a radius of each of the through holes.

$$2.0r<d<10.0r \quad \text{(A)}$$

According to a first aspect of the invention, there is also provided a method of arranging through holes in an RF module having a plurality of through holes, in which an electromagnetic wave propagates by using a region surrounded by the through holes, wherein the plurality of through holes are arranged so as to satisfy the following conditional expression (A) where d denotes an interval between centers of neighboring through holes and r indicates a radius of each of the through holes.

$$2.0r<d<10.0r \quad \text{(A)}$$

In the RF module according to the invention and the method of arranging through holes in the RF module according to the first aspect of the invention, arrangement of through holes is specified by the relation between the interval d between centers of neighboring through holes and the radius r of each through hole. Thus, arrangement of through holes can be optimized irrespective of a signal wavelength and the like.

In the RF module according to the invention and the method of arranging through holes in an RF module according to a first aspect of the invention, particularly, in the case where an RF module is constructed as a resonator of which side wall is formed by the plurality of through holes, it is preferable that the plurality of through holes be arranged so as to satisfy the following conditional expression (A-1).

$$3.6r<d<4.0r \quad \text{(A-1)}$$

In particular, in the case where the RF module is constructed as a transmission line of which side wall is formed by the plurality of through holes, it is preferable that the plurality of through holes be arranged so as to satisfy the following conditional expression (A-2).

$$3.6r<d<10.0r \quad \text{(A-2)}$$

In particular, in the case where the RF module is constructed as a resonator of which side wall is formed by the plurality of through holes, the plurality of through holes may be arranged so that attenuation of an electromagnetic wave in a non-propagation region between neighboring through holes is 20 dB or higher.

In particular, in the case where the RF module is constructed as a transmission line of which side wall is formed by the plurality of through holes, the plurality of through holes may be arranged so that attenuation of an electromagnetic wave in a non-propagation region between neighboring through holes is 15 dB or higher.

In the RF module according to the invention and the method of arranging through holes in the RF module according to a first aspect of the invention, the RF module having a non-uniform electromagnetic wave intensity distribution, it is preferable that the plurality of through holes be arranged so that the higher the electromagnetic field intensity is in a region, the smaller a center interval d is with respect to the radius r of each through hole.

According to a second aspect of the invention, there is provided a method of arranging through holes in an RF module having a plurality of through holes, in which an electromagnetic wave propagates by using a region surrounded by the through holes, wherein the relation between an interval d between centers of neighboring through holes and the radius r of each through hole is obtained from required attenuance of an electromagnetic wave, and arrangement of the through holes is determined on the basis of the obtained relation.

In the RF module according to the second aspect of the invention, the relation between the center interval d and the radius r of each through hole is obtained from the required attenuance of an electromagnetic wave. On the basis of the obtained relation, arrangement of the through holes is determined. Thus, irrespective of a signal wavelength and the like, arrangement of through holes is optimized.

Other and further objects, features and advantages of the invention will appear more fully from the following description.

BRIEF DESCRIPTION OF THE DRAWINGS

FIGS. 12A to 12C are diagrams showing an example of arrangement of through holes in the case where the center interval "d" is a value four times as large as the radius "r" of the through hole.

FIGS. 15A to 15C are diagrams showing results of measurement for the correlation between the attenuance and the no load Q in the cylindrical waveguide resonator.

FIG. 16 is a diagram showing the relation between a rotation symmetry angle θ and the ratio r/d between the through hole radius "r" and the center interval "d" in the cylindrical waveguide resonator shown in FIGS. 13A to 13G.

FIG. 17 is a diagram showing the values of the rotation symmetry angle θ obtained when the through hole radius "r" is changed while the value of the ratio r/d shown in FIG. 16 is fixed.

FIGS. 18A to 18C are diagrams showing a first measurement result of checking the correlation between the attenuance and the no load Q in the cylindrical waveguide resonator on the basis of the relation between the through hole radius "r" and the rotation symmetry angle "θ" shown in FIG. 17.

FIGS. 19A to 19C are diagrams showing a second measurement result of checking the correlation between the attenuance and the no load Q in the cylindrical waveguide resonator on the basis of the relation between the through hole radius "r" and the rotation symmetry angle "θ" shown in FIG. 17.

FIGS. 21A to 21C are plan views showing simplified concrete configuration examples of preferred cylindrical resonators obtained from the results of measurement.

FIGS. 22A to 22C are perspective views showing simplified concrete configuration examples of preferred cylindrical resonators obtained from the results of measurement.

DETAILED DESCRIPTION OF THE PRFERRED EMBODIMENTS

Embodiments of the invention will now be described in detail hereinbelow with reference to the drawings.

Figure 1:
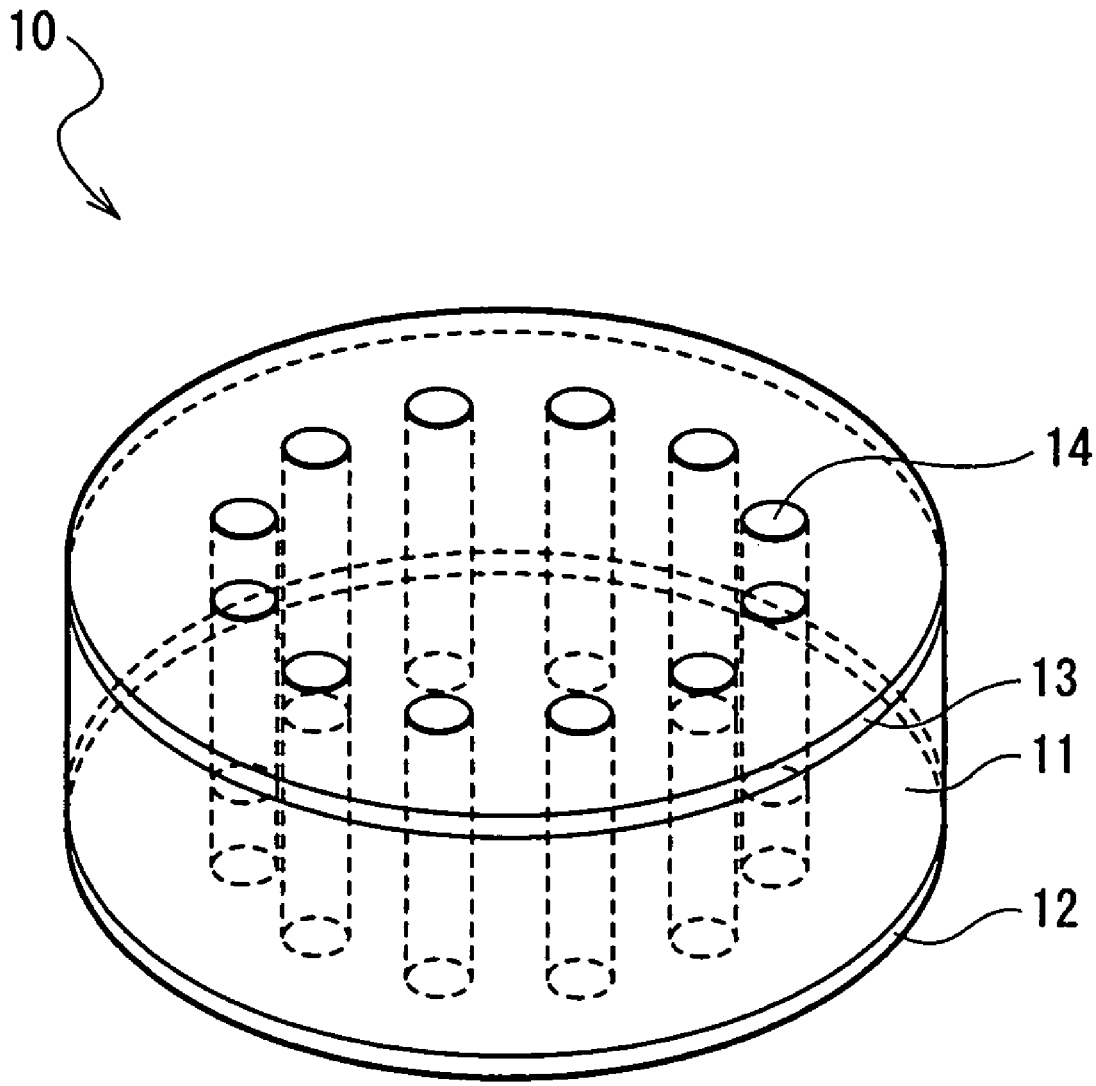
FIG. 1 is a perspective view illustrating main components of a cylindrical waveguide as an example of an RF module according to an embodiment of the invention.
Figure 2:
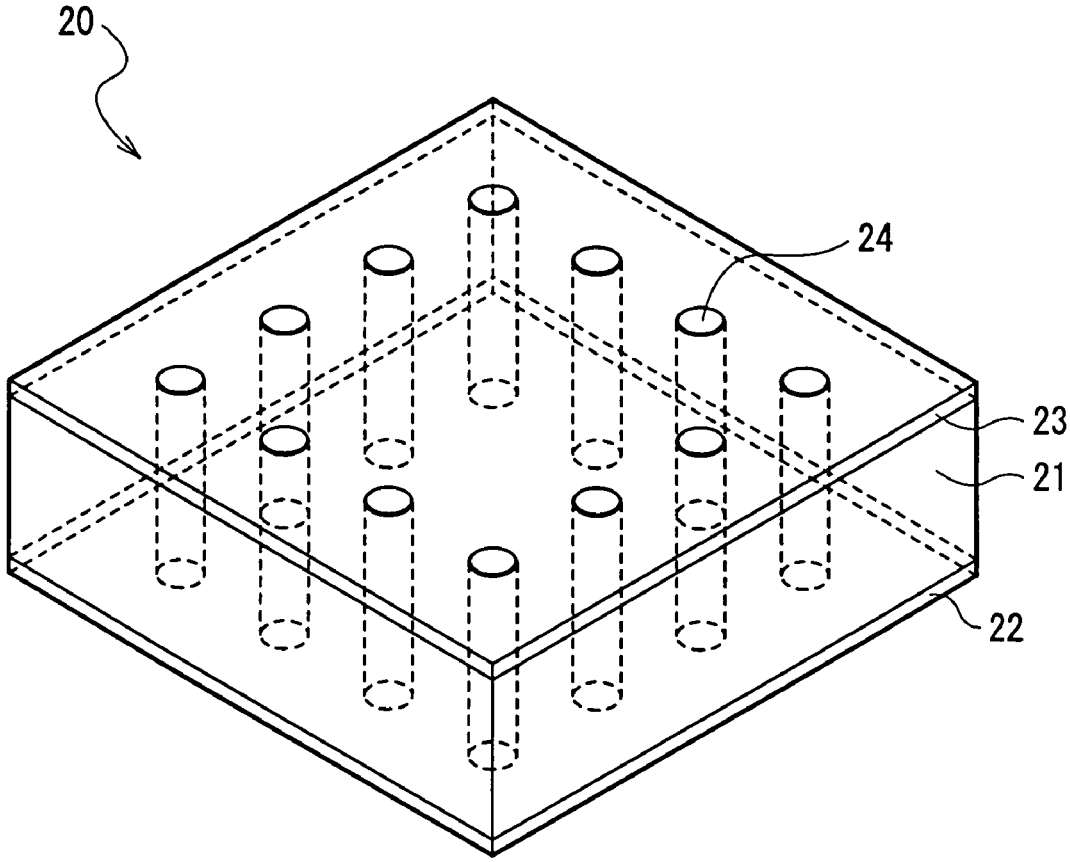
FIG. 2 is a perspective view illustrating main components of a rectangular-parallelepiped-shaped waveguide as an example of an RF module according to an embodiment of the invention.

FIGS. 1 and 2 are diagrams for explaining the configuration of an RF module according to an embodiment of the invention and show simplified main components of the RF module. In both of examples of configuration of FIGS. 1 and 2, the RF modules have a layer-stacked-type waveguide structure using through holes. In FIG. 1, an electromagnetic wave propagation region has a cylindrical shape as a whole. In FIG. 2, an electromagnetic wave propagation region has a rectangular parallelepiped shape as a whole. An RF module using any of the layer-stacked-type waveguide is combined with another transmission line, a resonator, and the like and is used as, for example, a transmission line, a filter, or the like for a high frequency signal.

A cylindrical waveguide 10 has a dielectric substrate 11, ground electrodes 12 and 13 which face each other while sandwiching the dielectric substrate 11, and a plurality of through holes 14 for bringing the ground electrodes 12 and 13 into conduction. The inner face of the through hole 14 is metalized. The sectional shape of the through hole 14 is an almost circular shape.

In the cylindrical waveguide 10, a pseudo conductor wall for electromagnetic waves is formed by the plurality of through holes 14. In a region surrounded by the plurality of through holes 14 and the ground electrodes 12 and 13, electromagnetic waves propagate. The plurality of through holes 14 are arranged in an almost circular shape as a whole, so that the electromagnetic wave propagation region formed by the through holes 14 and the ground electrodes 12 and 13 has an almost circular shape as a whole. The cylindrical waveguide 10 may have a configuration of a dielectric waveguide in which the electromagnetic wave propagation region is filled with a dielectric or a configuration of a cavity waveguide.

In the case of connecting/coupling the cylindrical waveguide 10 to another transmission line or the like, for example, a coupling window for connecting/coupling is provided in a part of the ground electrodes 12 and 13 or a part of a side wall formed by the through holes 14, and another transmission line or the like is connected/coupled via the coupling window indirectly or directly. The connecting/coupling structure is not particularly limited to the above but a conventional common technique can be used.

Figure 4:
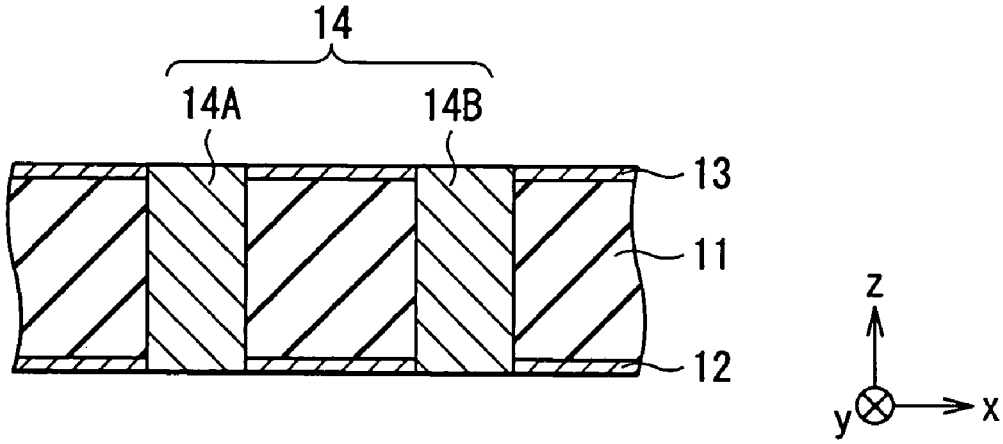
FIG. 4 is a cross section illustrating a structure of a waveguide which is simplified to obtain the attenuance of electromagnetic waves in a non-propagation region.
Figure 5:
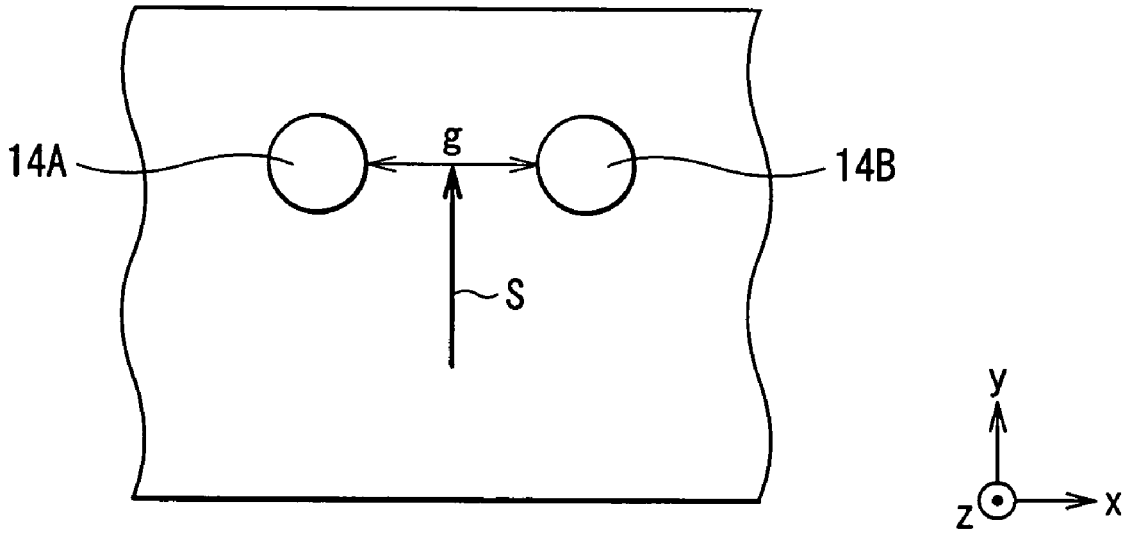
FIG. 5 is a plan view of the waveguide shown in FIG. 4.

FIGS. 4 and 5 are a partial cross section and a partial plan view of the cylindrical waveguide 10. It can be said that, when seen partially, the cylindrical waveguide 10 has a simple waveguide structure which is covered with electrodes from four sides (up, down, left, and right) by neighboring two through holes 14A and 14B and the ground electrodes 12 and 13.

Figure 6:
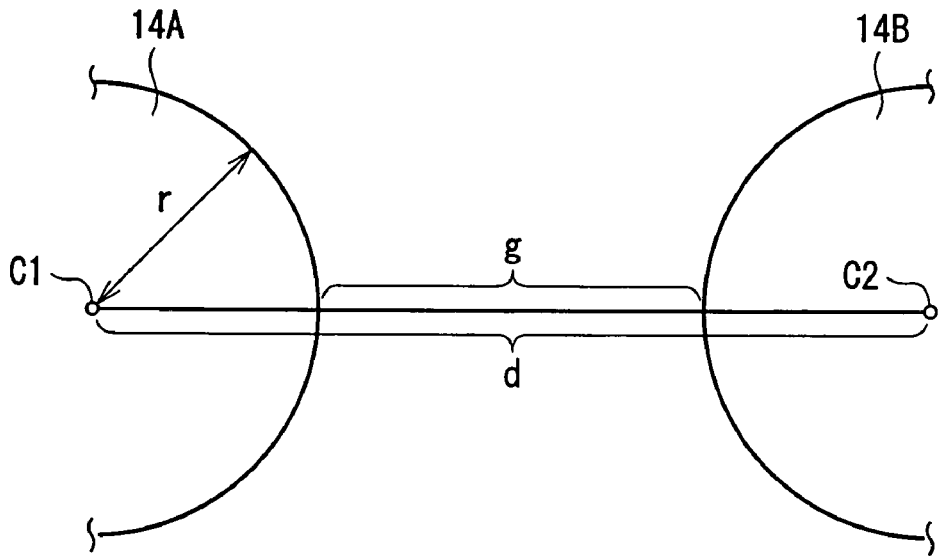
FIG. 6 is a diagram showing a concept of a through hole gap, the radius of a through hole, and an interval between centers of neighboring through holes.

In the diagram, the thickness (height) direction of the waveguide is expressed as "z", the width direction is expressed as "x", and a direction orthogonal to the directions "z" and "x" is indicated as "y". In the following description, as shown in FIG. 6, center positions in the through holes 14A and 14B will be described as C1 and C2, respectively, the interval of centers of the through holes 14A and 14B will be expressed as "d", the radius of each of the through holes 14A and 14B will be expressed as "r", and the shortest distance (through hole gap) between the peripheries of the through holes 14A and 14B will be indicated as "g".

When it is assumed that the through hole gap "g" is equal to or less than the cut-off wavelength in such a waveguide structure, an electromagnetic wave S propagating in the y direction of FIG. 5 in the through hole gap "g", generally, attenuates exponentially. The larger the through hole gap "g" is, the more the electromagnetic wave S leaks from the gap between the neighboring two through holes 14A and 14B. Therefore, the through holes 14 have to be provided at an interval which is equal to or less than a certain value so that the electromagnetic wave S does not leak to the outside of the propagation region. If the interval is equal to or less than the certain value, all of the through holes 14 do not have to be provided at regular intervals but may be provided at irregular intervals.

Concretely, in the cylindrical waveguide 10, the through holes 14 are arranged so as to satisfy the following conditional expression (A) so that the electromagnetic wave S is not leaked excessively from the gap between the neighboring two through holes 14A and 14B. The frequency band of electromagnetic waves is, for example, about 20 GHz to 120 GHz, more preferably, about 20 GHz to 60 GHz.

$$2.0r<d<10.0r \quad \text{(A)}$$

In the case of using the cylindrical waveguide 10 as a resonator, it is particularly preferable that the through holes 14 are arranged so as to satisfy the following conditional expression (A-1).

$$3.6r<d<4.0r \quad \text{(A-1)}$$

In the case of using the cylindrical waveguide 10 as a transmission line, it is particularly preferable that the through holes 14 are arranged so as to satisfy the following conditional expression (A-2).

$$3.6r<d<10.0r \quad \text{(A-2)}$$

Further, the through holes 14 may be arranged so as to satisfy the following conditional expression together with any of the above conditional expressions. λ0 denotes a wavelength corresponding to a cut-off frequency f0 of frequencies of at least a part of a frequency band used. "g" denotes a through hole gap and g=d−2r.

$$\lambda 0/4<g$$

In the case of using the cylindrical waveguide 10 as a resonator, generally, it is preferable to arrange the plurality of through holes 14 so that attenuation of electromagnetic waves in a non-propagation region between neighboring through holes becomes 20 dB or higher. More preferably, the plurality of through holes 14 are arranged so that the attenuation lies in a range from 25 dB to 30 dB.

In the case of using the cylindrical waveguide 10 as a transmission line, generally, the permissible attenuance may be generally lower than that of a resonator. Concretely, it is generally sufficient that the through holes 14 are arranged so that attenuation of electromagnetic waves is 5 dB or higher, more preferably, 15 dB or higher.

The grounds for using the above-described conditional expressions and the ranges of the attenuance of electromagnetic waves will be described later.

A rectangular-parallelepiped-shaped waveguide 20 shown in FIG. 2 has a structure substantially similar to that of the cylindrical waveguide 10 shown in FIG. 1 except that the electromagnetic wave propagation region has a rectangular parallelepiped shape. Specifically, the rectangular-parallelepiped-shaped waveguide 20 similarly has a dielectric substrate 21, ground electrodes 22 and 23 which face each other while sandwiching the dielectric substrate 21, and a plurality of through holes 24 for bringing the ground electrodes 22 and 23 into conduction.

In the rectangular-parallelepiped-shaped waveguide 20, the plurality of through holes 24 are arranged in an almost square shape as a whole. Accordingly, an electromagnetic wave propagation region surrounded by the through holes 24 and the ground electrodes 22 and 23 has an almost rectangular-parallelepiped shape as a whole.

Also in the rectangular-parallelepiped-shaped waveguide 20, the through holes 24 have to be provided at intervals each of which is equal to or less than a certain value so that electromagnetic waves do not leak to the outside of the propagation region. In this case, basically, it is sufficient to provide the through holes 24 at intervals similar to those of the cylindrical waveguide 10. In the rectangular-parallelepiped-shaped waveguide 20, however, since the intensity distribution of electromagnetic waves in a wall face portion formed by the through holes 24 is non-uniform, it is desirable to dispose the through holes 24 in consideration of the intensity distribution of the electromagnetic waves.

Figure 3:
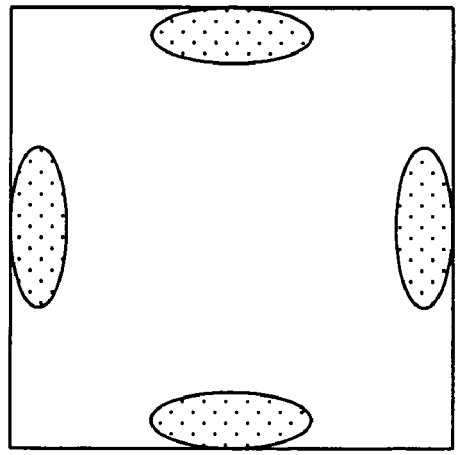
FIG. 3 is a diagram showing an example of a magnetic field distribution in a polygonal-shaped waveguide.

FIG. 3 shows an example of the intensity distribution of a magnetic field in an H plane (plane parallel to the magnetic field) in a mode of the lowest order in the rectangular-parallelepiped-shaped waveguide 20. In the diagram, in hatched regions, the magnetic intensity is high. In the rectangular-parallelepiped-shaped waveguide 20, for example, the magnetic field intensity is relatively strong in a center portion of a wall face. It is considered that electromagnetic waves leak more in the region where the electromagnetic wave intensity is strong in the side wall portion formed by the through holes 24. Preferably, in a region, the higher the electromagnetic field intensity is, the narrower the intervals of providing the through holes 24 are set. In other words, in a region, the higher the electromagnetic field intensity is, it is preferable to set the center interval "d" to be a value smaller with respect to the radius "r" of a through hole.

In the cylindrical waveguide 10 and the rectangular-parallelepiped-shaped waveguide 20 having the above-described configuration, arrangement of the through holes 14 and 24 is specified on the basis of the relation between the interval "d" of centers of neighboring through holes and the radius "r" of each through hole. In such a manner, the arrangement of the through holes 14 and 24 is optimized irrespective of a signal wavelength and the like.

A method of determining arrangement of through holes will now be described. The grounds for using the above-described conditional expressions and the ranges of the attenuance of electromagnetic waves will be also explained.

In order to determine arrangement of the through holes 14, the attenuance when electromagnetic waves pass through the gap between the neighboring through holes 14A and 14B will be examined.

(1) Interval of Through Holes and the Attenuance

First, the attenuance was measured when the interval "d" of centers of neighboring through holes (refer to FIG. 6) was continuously varied while the dielectric constant $\epsilon r$ of the dielectric substrate 11 was fixed to 7.3, the signal frequency f was fixed at 25 GHz, and the through hole radius "r" was fixed to 0.1 mm.

Figure 7:
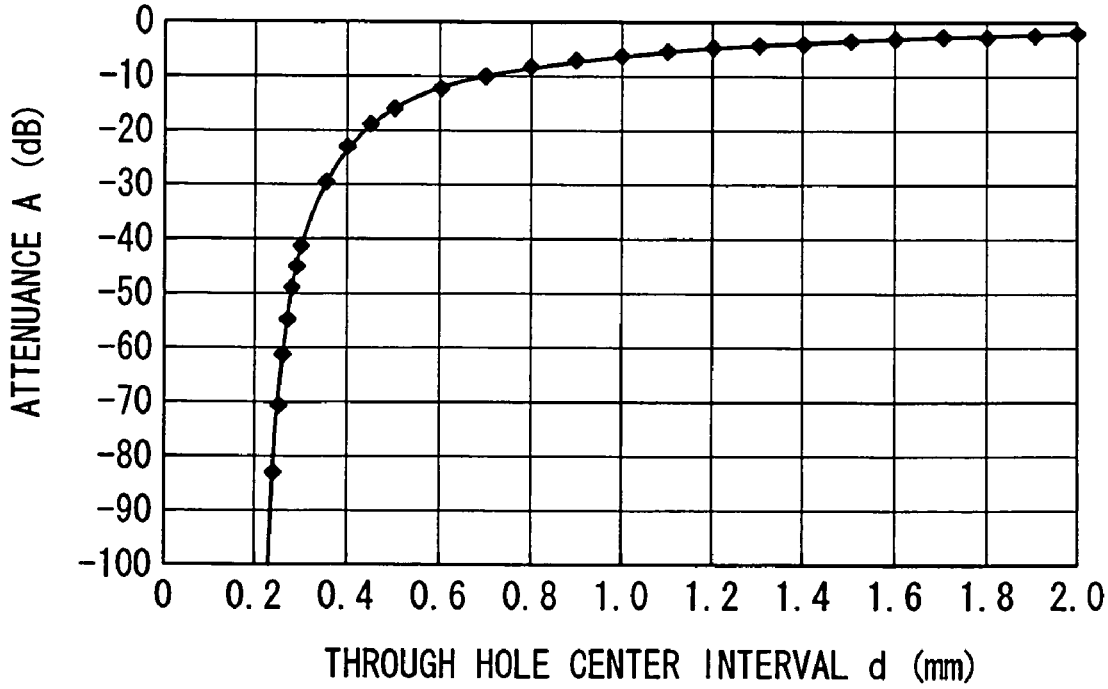
FIG. 7 is a graph showing the relation between the interval "d" of centers of neighboring through holes and the attenuance.

FIG. 7 is a graph showing the measurement result, in which the horizontal axis indicates the through hole center interval "d" (mm) and the vertical axis denotes the attenuance A (dB). It is understood from the graph that the attenuance diverges at d=0.2 mm (that is, d=2r). This is because when d=2r, the through hole gap "g" becomes zero and the transmission line is completely closed, so that the result is understandable.

(2) Dependency on Frequency of the Attenuance

Next, the dependency on frequency of the attenuance was examined. Changes in the attenuance A were measured when the signal was continuously varied while the dielectric constant $\epsilon r$ of the dielectric substrate 11 was fixed to 7.3, the through hole center interval "d" was fixed to 0.4 mm, and the through hole radius "r" was fixed to 0.1 mm (that is, the through hole gap "g"=the through hole diameter 2r).

Figure 8:
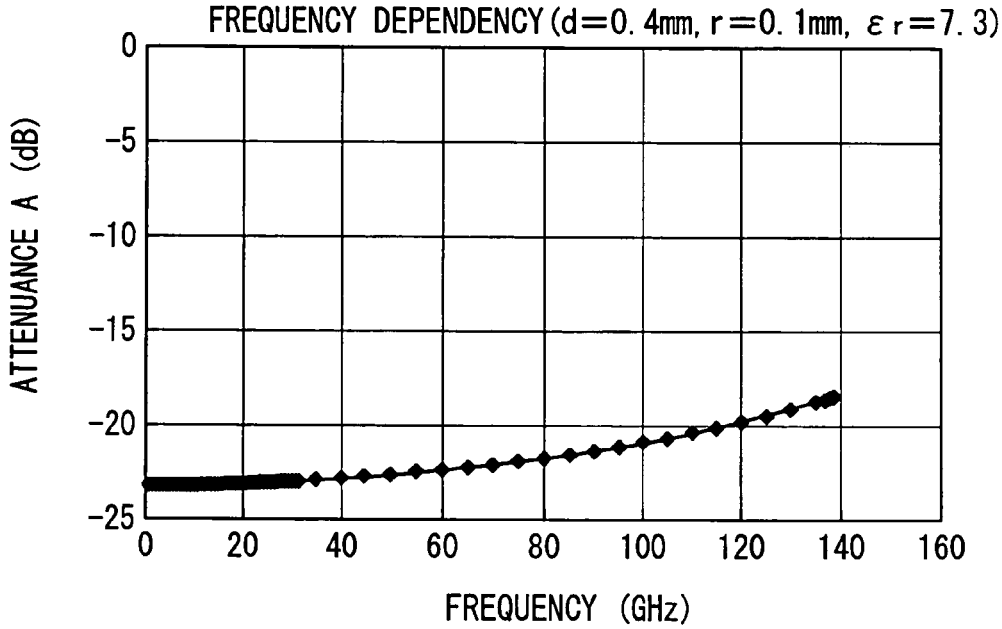
FIG. 8 is a graph showing the relation between frequency and the attenuance to check frequency dependency of the attenuance.

FIG. 8 is a graph showing the measurement result, in which the horizontal axis indicates frequency (GHz) and the vertical axis denotes the attenuance A (dB). It is understood from the results of the measurement that the value of the attenuance A hardly changes up to around 120 GHz. In particular, up to around 60 GHz, the attenuance A is almost flat. That is, it is understood that the attenuance A hardly depends on the frequency from 20 GHz up to around 120 GHz. A normal frequency used in the waveguide is in a range from 20 GHz to 30 GHz. When the frequency lies in the frequency range, the frequency dependency is at an ignorable level.

(3) Dependency on Dielectric Constant of the Attenuance A

Dependency on the dielectric constant of the attenuance was examined. Changes in the attenuance A were measured in a state where the dielectric constant was varied from 1 to 200 while the through hole center interval d was fixed to 0.4 mm, the signal frequency f was fixed at 25 GHz, and the through hole radius "r" was fixed to 0.1 mm.

Figure 9:
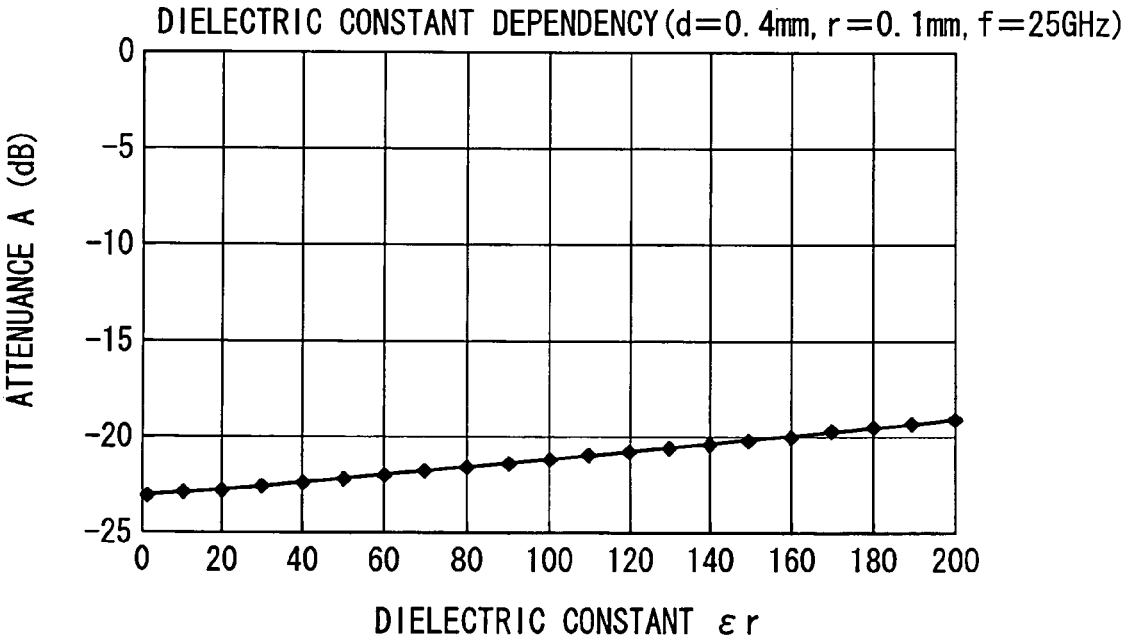
FIG. 9 is a graph showing the relation between dielectric constant and the attenuance to check dependency on the dielectric constant of the attenuance.

FIG. 9 is a graph showing the measurement result, in which the horizontal axis denotes the dielectric constant $\epsilon r$ and the vertical axis indicates the attenuance A (dB). It is understood from FIG. 9 that the attenuance of the waveguide using the through holes 14 hardly depends on the material of the dielectric substrate 11 within the range of the dielectric which is usually used.

It is understood from the results of measurement that, in the waveguide structure using the through holes 14, the attenuance hardly depends on the frequency and the dielectric constant. It is different from the conventional idea, and the results are very interesting. It is estimated that, in the waveguide structure using the through holes 14, the cut-off wavelength is much shorter than the wavelength of an actual signal frequency, so that the attenuance hardly depends on the frequency and the dielectric constant of the substrate but depends on only the cut-off wavelength of the waveguide using the through holes 14.

(4) Interval between Through Holes and the Radius of Through Hole

Influences of the through hole center interval "d" and the through hole radius "r" exert on the attenuance A will now be considered.

Figure 10:
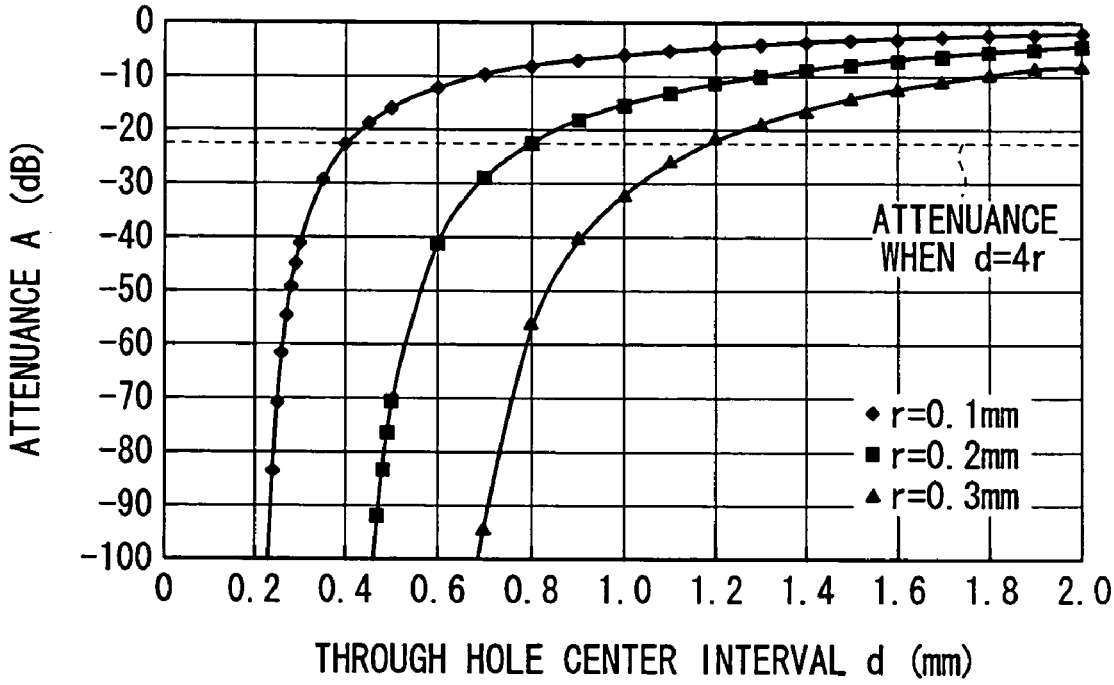
FIG. 10 is a graph showing the relation between the interval "d" of centers of neighboring through holes and the attenuance when the radius "r" of a through hole is changed.

First, the relation between the through hole center interval "d" and the attenuance A was measured in a state that the through hole radius "r" was varied to 0.1 mm, 0.2 mm, and 0.3 mm while the dielectric constant $\epsilon r$ of the dielectric substrate 11 was fixed to 7.3 and the signal frequency f was fixed at 25 GHz. FIG. 10 is a graph showing the measurement results, in which the horizontal axis denotes the through hole center interval "d" (mm) and the vertical axis denotes the attenuance A (dB).

In FIG. 10, when the attenuance at a value where the through hole interval "d" is four times as large as the through hole radius "r" (d=4r, that is, the through hole gap g=through hole diameter 2r) is compared with each of the cases where the through hole radius is 0.1 mm, 0.2 mm, and 0.3 mm, the same value is obtained at the attenuation of about 23 dB in all of the cases. This means that if the ratio between the through hole center interval "d" and the through hole radius "r" is constant, almost the same attenuance is obtained.

Figure 11:
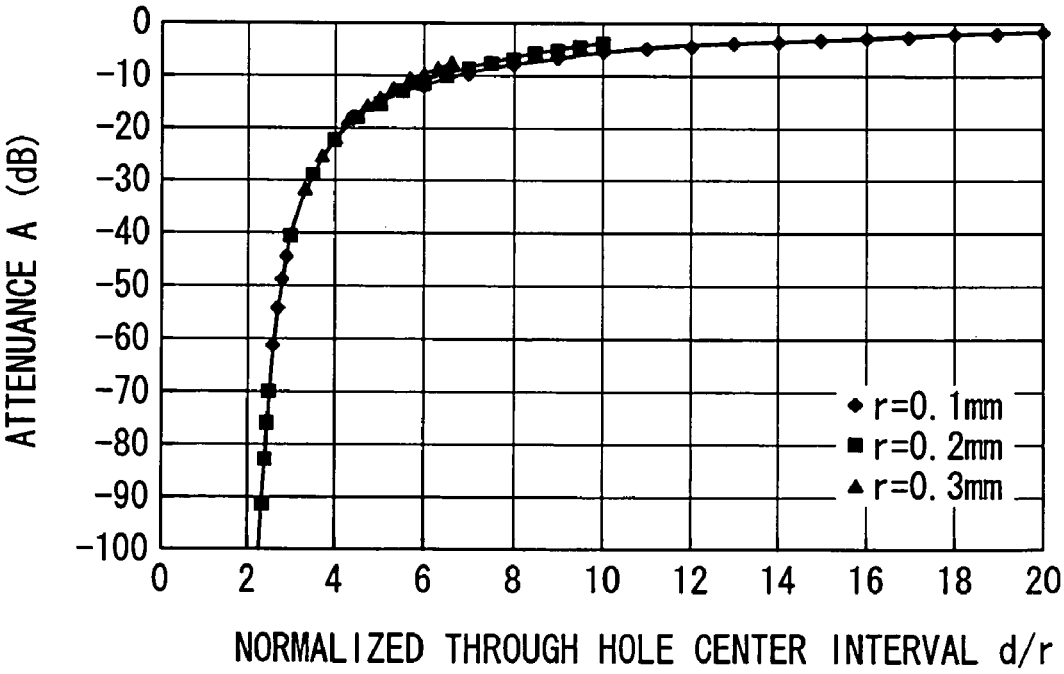
FIG. 11 is a diagram showing the interval "d" of centers of neighboring through holes, which is normalized with the through hole radius "r" in accordance with a result of measurement of FIG. 10.
Figure 13A:
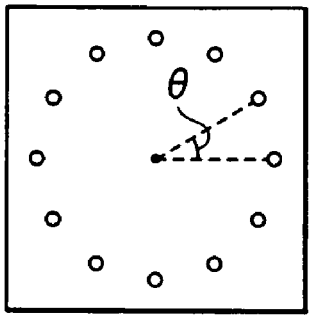
FIGS. 13A to 13G are diagrams showing patterns of arrangement of through holes in a cylindrical waveguide resonator of which no load Q is to be measured.
Figure 13B:
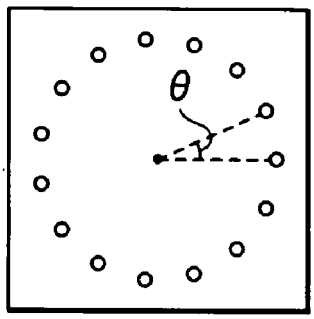
Figure 13C:
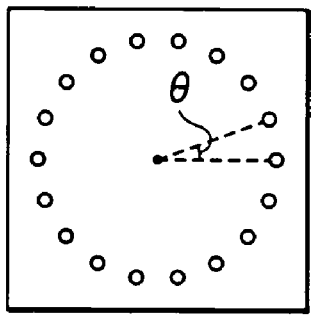
Figure 13D:
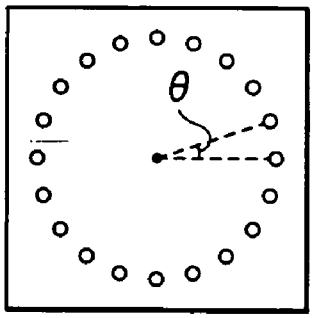
Figure 13E:
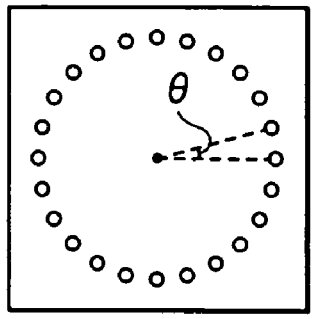
Figure 13F:
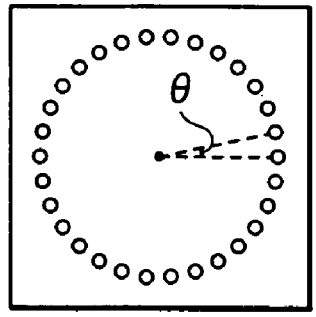
Figure 13G:
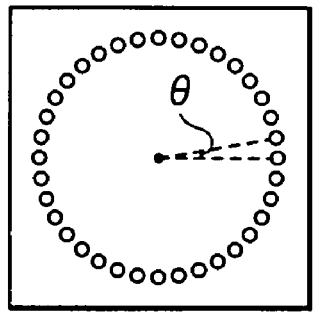

FIG. 11 is a graph obtained by normalizing the through hole interval "d" with the through hole radius "r" and plotting again the measurement results shown in FIG. 10 by using the horizontal axis as d/r. Measurement results are also obtained from the graph that when the ratio between the through hole radius "r" and the through hole center interval "d" is constant, the attenuance is almost the same. The meaning of the phenomenon will now be considered from the physical viewpoint.

FIGS. 12A to 12C show arrangements of the through holes 14 satisfying the condition of d=4r in the cases where the through hole radius r=0.1 mm, 0.2 mm, and 0.3 mm, respectively. The arrangements of FIGS. 12A, 12B, and 12C will be described below as case 1, case 2, and case 3, respectively.

From the measurement results shown in FIG. 10, the electromagnetic waves passing through the waveguides attenuate at the same attenuance in the cases 1, 2, and 3. When the case 3 (FIG. 12C) and the case 1 (FIG. 12A) are compared with each other, the interval between through holes in the case 3 is wider, so that an attenuation constant is low. However, the diameter of the through hole 14 in the case 3 is larger, so that the attenuation distance is three times as long as that in the case 1. That is, in the case 3, as compared with the case 1, the interval between the through holes is wide, so that the attenuance per unit length is low. However, the attenuation distance is long, so that the low attenuance is canceled off and the attenuance as a whole becomes the same as that in the case 1.

It is understood from the above measurement results that when the value of the required attenuance is determined, the relation between the center interval "d" and the radius "r" of a through hole can be obtained from the graph of FIG. 11, and arrangement of through holes can be determined on the basis of the relation.

For example, in the case of using the cylindrical waveguide 10 as a transmission line, when it is assumed that the required attenuance is about 5 dB or higher, the relation between d and r corresponding to the required attenuance is obtained from the graph of FIG. 11 as shown by the following conditional expression (A).

$$2.0r<d<10.0r \quad (A)$$

From another viewpoint, it is understood from the above measurement results that, in the case where the diameter of a through hole is increased and the attenuance is set to be the same in the waveguide constructed by the plurality of through holes 14, the number of through holes 14 to be provided can be decreased.

<No Load Q of Cylindrical Waveguide Resonator using Through Holes>

From the measurement results described above, the attenuance of the electromagnetic waves by the through holes can be understood to a certain degree. There must be some correlation between the attenuance A and the no load Q of the resonator. The no load Q in a dominant mode in the case where the cylindrical waveguide 10 is used as a resonator was measured and the result of measurement was verified.

FIGS. 13A to 13G show arrangement patterns of the through holes 14 in the cylindrical waveguide resonator to be measured. In each of the arrangement patterns of the through holes 14, the through holes 14 are arranged so as to have rotation symmetry of an angle θ. The angles θ in the arrangement patterns in FIGS. 13A to 13G are 30°, 24°, 20°, 18°, 15°, 12°, and 10°, respectively.

Figure 14:
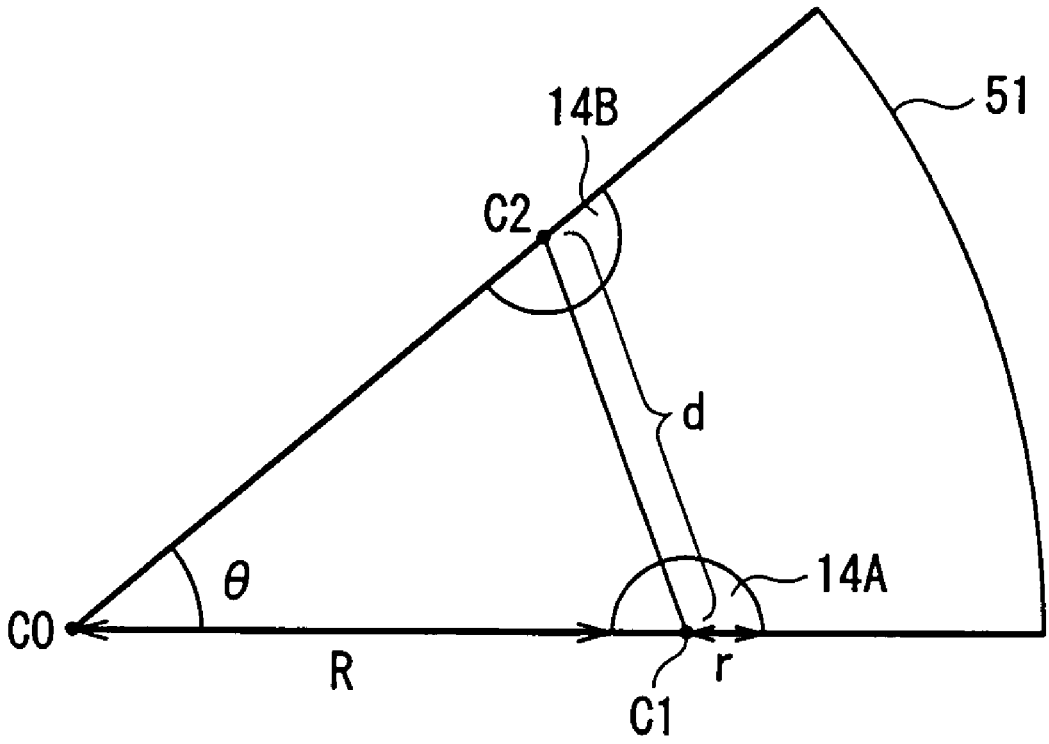
FIG. 14 is a diagram for explaining parameters used for the measurement of no load Q.

The angle θ denotes an angle formed by, as shown in FIG. 14, two straight lines connecting the center position C0 of the whole resonator and the center positions C1 and C2 of neighboring through holes 14A and 14B.

The cylindrical waveguide resonators of FIGS. 13A to 13G are designed so as to resonate when the radius "r" of each through hole is 0.1 mm, the dielectric constant "r" of a dielectric (s39 material) is 7.3, and the frequency is about 25 GHz. The length from the center position C0 of the whole resonator to the outermost face 51 of the resonator (refer to FIG. 14) is 3.0 mm and the length R from the resonator center C0 to the through hole 14 is 1.7 mm. The conductor portions of the ground electrodes 12 and 13 on the bottom face and top face of the resonator have electric conductivity σ of 3.0 E7 (E7=$10^7$). To evaluate a radiation loss, measurement was performed with respect to two cases; a case where the electric conductivity σ of the conductor of the outermost face 51 of the resonator is 3.0E7 and a case where σ=1.

As the reasons why the cylindrical resonator is used as a measurement model, the following points can be mentioned; a point that the dominant mode of the cylindrical resonator does not have dependency on the angle direction and the condition is the same with respect to all of the through holes 14 (in the case of the rectangular-parallelepiped-shaped resonator, the magnetic field intensity distributes in an sin function on the waveguide wall face) and a point that the electromagnetic wave is perpendicularly incident on the waveguide wall face constructed by the through holes 14.

Measurement Result (1) (in the Case where r=0.1 mm)

FIGS. 15A to 15C show the measurement results. Measurement was conducted with respect to three kinds of the thickness "h" of the resonator of 0.2 mm, 0.3 mm, and 0.4 mm. "f" and "Q" are values of the resonance frequency and the no load Q, respectively, in the case where the outermost surface 51 of the resonator is covered with a metal (in the case where a is 3.0E7, that is, zero radiation loss). "fr" and "Qr" denote values in the case where the electric conductivity a of the outermost surface 51 is set to 1 (that is, with a radiation loss). For comparison, the theoretical values of the resonance frequency and the no load Q in the case where the side face of the resonator is formed by not through holes but a normal metal wall are shown. It is understood from the measurement results of FIGS. 15A to 15C that, as the through hole center interval "d" decreases (as the angle θ decreases), the value of the no load Q (Qr) to which the radiation loss is added gradually increases and is saturated at a value around the no load Q of the theoretical value.

The no load Q in the case where the through hole radius "r" is changed will now be examined. As already described, in the waveguide structure of FIG. 4, when the ratio between the through hole radius "r" and the through hole center interval "d" is constant, the attenuance A of the electromagnetic wave in the non-propagation region constructed by the two through holes 14A and 14B becomes almost constant. The fact that when the ratio rid between the radius "r" of the through hole 14 and the center interval "d" is constant, the attenuance A is constant denotes that when the radius "r" is increased, by increasing the center interval "d" at the same ratio, almost equal attenuance A can be obtained in each of the configurations.

FIG. 16 shows the relation between the rotation symmetry angle θ and r/d in the cylindrical waveguide resonators of FIGS. 13A to 13G. The value of the radius "r" of a through hole in this case is 0.1 mm as described above. In the cylindrical waveguide resonator, to widen the through hole center interval "d" while the resonator radius R (refer to FIG. 14) is fixed, the rotation symmetrical angle θ has to be increased.

The through hole center interval "d" in the cylindrical resonator is obtained by the following formula 1 (refer to FIG. 14 for the relations of R, r, d, and θ).

$$d = 2\times(R+r)\sin\frac{\theta}{2} \quad \text{[Formula 1]}$$

When relational expressions of the rotation symmetry angle θ are obtained from the formula 1, the following formulas 2 and 3 are derived.

$$\sin\frac{\theta}{2} = \frac{d}{2(R+r)} = \frac{1}{2\left(\frac{r}{d}\right)\left(\frac{R}{r}+1\right)} \quad \text{[Formula 2]}$$

$$\theta = 2\sin^{-1}\left\{\frac{1}{2\left(\frac{r}{d}\right)\left(\frac{R}{r}+1\right)}\right\} \quad \text{[Formula 3]}$$

When the rotation symmetry angle θ is calculated in accordance with the formula 3 in the case where r/d is fixed to the value shown in FIG. 16 and the through hole radius "r" is varied to 0.2 mm and 0.3 mm, the results as shown in FIG. 17 are obtained.

Measurement Result (2) (in the Case where r=0.2 mm and 0.3 mm)

FIGS. 18A to 18C and FIGS. 19A to 19C show measurement results such as the attenuance A and the no load Q in the case where the through hole radius "r" is set to 0.2 mm and 0.3 mm and the rotation symmetry angle θ is increased as shown in FIG. 17. Measurement was conducted while setting the thickness "h" of the resonator to three kinds of values of 0.2 mm, 0.3 mm, and 0.4 mm. The meanings of "f", "Q", "fr", and "Qr", and the like are similar to those in the case where r=0.1 mm.

From any of the results, it is understood that the no load Q is saturated at a value around the theoretical value when the attenuance A is about 26 dB in the non-propagation region between the through holes 14A and 14B. In a region where the center interval "d" is wide (the angle θ is large) and sufficient attenuation is not obtained, electromagnetic waves are leaked and a radiation loss occurs. Consequently, as compared with the no load Q (Q) measured with no radiation loss, the no load Q (Qr) deteriorates more conspicuously.

Summary of the Measurement Results (1) and (2)

Figure 20:
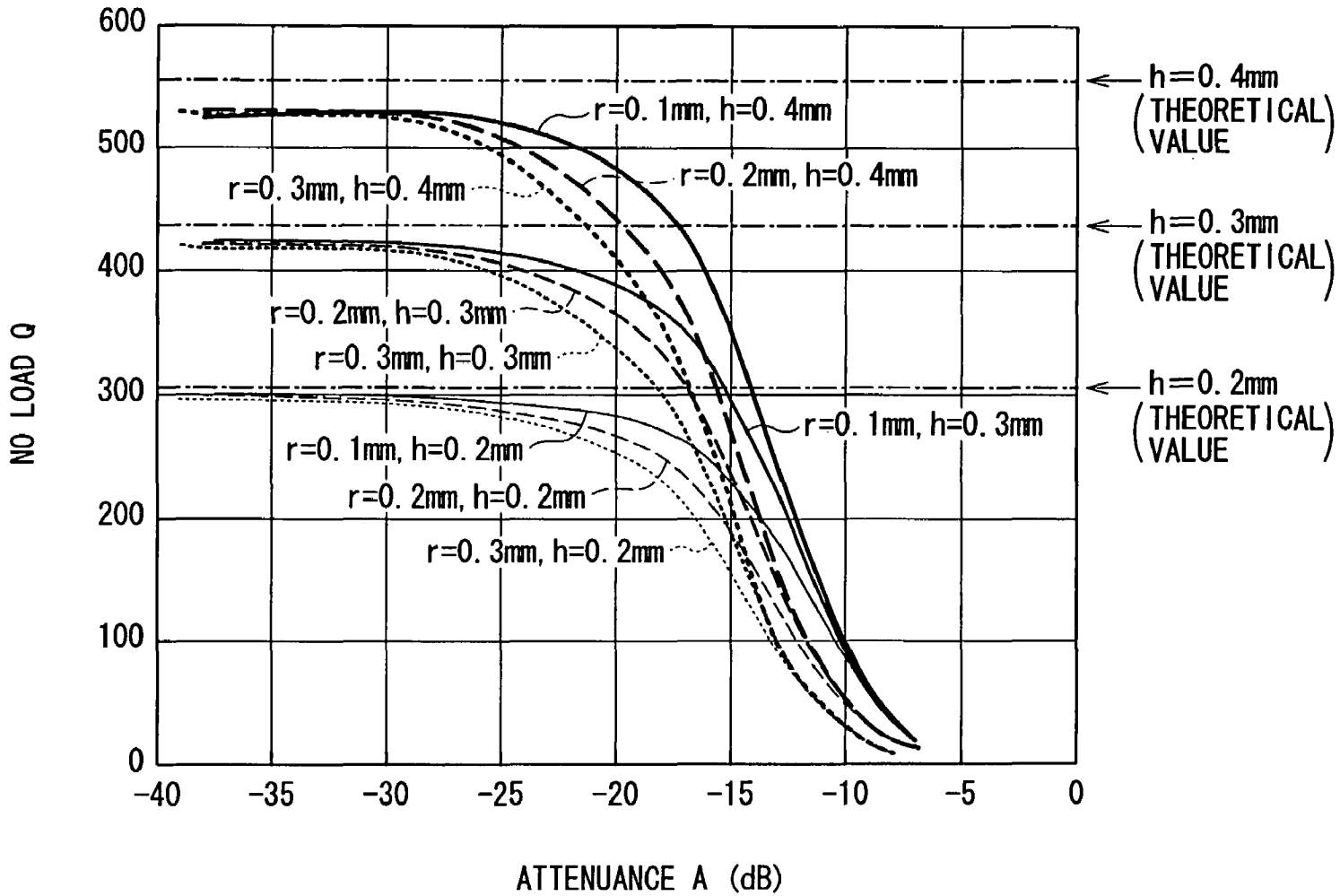
FIG. 20 is a graph showing results of measurement of FIGS. 15A to 15C, FIGS. 18A to 18C, and FIGS. 19A to 19C.

FIGS. 15A to 15C, FIGS. 18A to 18C, and FIGS. 19A to 19C show the measurement results with respect to the cases where the through hole radiuses r=0.1 mm, 0.2 mm, and 0.3 mm, respectively. FIG. 20 is a graph showing the relation between the attenuance A in a through hole part and the no load Q (Qr) obtained from the measurement results, in which the horizontal axis denotes the attenuance A (dB) and the vertical axis indicates the no load Q. The no load Q of the theoretical value of the cylindrical resonator in each of the cases where the thickness h=0.2 mm, 0.3 mm, and 0.4 mm is also shown by dashed line.

As understood from FIGS. 15A to 15C, FIGS. 18A to 18C, and FIGS. 19A to 19C, and the graph of FIG. 20, by arranging the through holes 14 gradually and densely (by decreasing the center interval "d"), the value is getting closer to the no load Q of the theoretical value.

It is understood from FIG. 20 that by setting attenuation of the through hole part to about 25 dB to 30 dB, a value close to the no load Q of the theoretical value can be obtained. It means that, with reference to the relation between the normalized center interval d/r and the attenuance A shown in FIG. 11, by setting the through hole center interval "d" to about 3.6 times to 4.0 times as large as the through hole radius "r", radiation can be sufficiently prevented.

Specifically, in the case of constructing a cylindrical resonator by using the through holes 14, to obtain a preferable no load Q, it is sufficient to arrange the through holes 14 so as to satisfy the following conditional expression (A-1) irrespective of a signal wavelength or the like.

$$3.6r<d<4.0r \quad \text{(A-1)}$$

In the case of constructing a cylindrical transmission line by using the through holes 14, it is considered that attenuation can be permitted to about 5 dB to 30 dB. In this case as well, when the relation between the center interval "d" and the radius "r" is similarly obtained from FIG. 11, the following conditional expression (A-2) is obtained.

$$3.6r<d<10.0r \quad \text{(A-2)}$$

In a conventional example, through holes are arranged at intervals each of which is equal to or less than the cut-off wavelength. In the embodiment, the interval is not limited to the cut-off wavelength or less. The through holes may be arranged so as to satisfy, for example, the following conditional expression together with the above-described conditional expressions. λ0 denotes a wavelength corresponding to a cut-off frequency f0 of at least a part of the frequencies in a frequency band used. "g" denotes a through hole gap, and g=d−2r.

$$\lambda 0/4<g$$

FIGS. 21A to 21C and FIGS. 22A to 22C show concrete configuration examples of a preferred cylindrical resonator obtained from the above-described measurement results. In the diagrams, the configurations are simplified and shown partially. The basic general configuration is similar to that of the cylindrical waveguide 10 shown in FIG. 1.

The cylindrical resonators are structure examples in which attenuation of about 38 dB is obtained in a through hole part, and thickness "h" is 0.4 mm. The radiuses "r" of through holes 54A, 54B, and 54C are 0.1 mm, 0.2 mm, and 0.3 mm, respectively. In any of the cases, the no load Q is about 530 which is almost the same as the no load Q of the theoretical value. As understood from the configuration examples of the diagrams, in the case where the radius "r" of the through hole is set to be large, by accordingly widening the center interval "d", an equivalent no load Q is obtained. That is, it means that it was proved that by increasing the through hole radius, the number of through holes can be decreased.

The relations of the through hole radius "r", the through hole center interval "d", and a radiation loss can be analyzed as described above to a certain extent. It is understood from results of analysis that, different from the conventional knowledge, the dielectric constant of the substrate in which the through holes 14 are provided and the frequency hardly exert an influence on attenuation of the electromagnetic waves in the substrate. This result can be applied to a wide range and can be applied also to designing of a substrate.

It means that the interval of the through holes 14 provided in the substrate 11 has to be considered on the basis of, not the wavelength, but the ratio between the through hole radius "r" and the through hole center interval "d". Although the attenuance at the frequency of 25 GHz is measured in this example, in reality, the value of attenuance hardly changes even at the frequency of 1 GHz.

Therefore, for example, in the case of designing the cylindrical waveguide 10 shown in FIG. 1, it is sufficient to obtain the relation between the center interval "d" and the radius "r" of each through hole from the required attenuance of electromagnetic waves by using the graph of FIG. 11 and determine arrangement of the through holes on the basis of the obtained relation.

Although measurement was conducted with respect to the structure of the cylindrical type having no angle dependency this time, almost similar results are expected with respect to a rectangular parallelepiped structure. In a rectangular-parallelepiped structure, however, since the electromagnetic wave is not uniform on the wall surface, the intervals of through holes may be changed according to the distribution of the electromagnetic wave.

As described above, according to the embodiment, arrangement of through holes is specified on the basis of the relation between the interval "d" of centers of neighboring through holes and the radius "r" of each through hole. Thus, arrangement of through holes can be optimized irrespective of a signal wavelength and the like. By the RF module having the through holes arranged as described above, electromagnetic waves can be propagated efficiently.

The present invention is not limited to the foregoing embodiments but can be variously modified. Although the example of the configuration that the ground electrode is formed by two layers has been described in the foregoing embodiment, the invention can be also applied to a multi-layered structure having a ground electrode of three or more layers. The method of arranging through holes according to the invention can be applied not only to the cylindrical waveguide 10 and the rectangular-parallelepiped waveguide

20 but also other waveguides each having a layer-stacked structure using through holes.

Although the case where the sectional shape of a through hole is a circle has been described in the foregoing embodiments, also in the case where the sectional shape may be a polygonal shape similar to a circle, an oval shape close to a circle, or the like, by using similar arrangement, similar effects may be obtained. It can be also considered that even when the radiuses "r" of through holes are not the same but are at least in a range of a manufacture error or the like, by using similar arrangement, similar effects may be obtained.

In the RF module and the method of arranging through holes in the RF module according to the invention, arrangement of through holes is specified on the basis of the relation between the center interval "d" of neighboring through holes and the radius "r" of a through hole. Consequently, arrangement of the through holes can be optimized irrespective of a signal wavelength and the like. By the RF module having the through holes arranged as described above, electromagnetic waves can be propagated efficiently.

According to the method of arranging through holes in the RF module of the invention, the relation between the center interval "d" of neighboring through holes and the radius "r" of a through hole is obtained from the required attenuance of electromagnetic waves. On the basis of the obtained relation, arrangement of through holes is determined. Thus, arrangement of through holes can be optimized irrespective of a signal wavelength and the like. By the RF module having through holes arranged as described above, electromagnetic waves can be efficiently propagated.

Obviously many modifications and variations of the present invention are possible in the light of the above teachings. It is therefore to be understood that within the scope of the appended claims, the invention may be practiced otherwise than as specifically described.

What is claimed is:

1. An RF module having ground electrodes facing each other and a plurality of through holes bringing the ground electrodes into conduction, in which an electromagnetic wave propagates by using a region surrounded by the ground electrodes and the through holes, wherein the plurality of through holes are arranged so as to satisfy the following conditional expression (A) where d denotes an interval between centers of neighboring through holes and r indicates a radius of each of the through holes $$3.6r<d<4.0r \quad \text{(A-1)}.$$

2. An RF module according to claim 1, constructed as a resonator of which side wall is formed by the plurality of through holes.

3. An RF module according to claim 1, constructed as a transmission line of which side wall is formed by the plurality of through holes.

4. An RF module according to claim 1, wherein the plurality of through holes are arranged so that attenuation of an electromagnetic wave in a non-propagation region between neighboring through holes is 20 dB or higher.

5. An RF module according to claim 1, having a non-uniform electromagnetic wave intensity distribution, wherein the plurality of through holes are arranged so that the higher the electromagnetic field intensity is in a region, the smaller a center interval "d" is with respect to the radius "r" of each through hole.

6. An RF module according to claim 1, wherein a frequency bandwidth of the electromagnetic wave is a range from 20 GHz to 120 GHz.

7. An RF module according to claim 1, wherein when a wavelength corresponding to a cut-off wavelength F0 of a frequency of at least a part of a frequency band used is $\lambda 0$, $\lambda 0/4<g$ (where $g=d-2r$) is satisfied.

* * * * *